United States Patent [19]

Watanabe et al.

[11] Patent Number: 4,971,759

[45] Date of Patent: Nov. 20, 1990

[54] METALLIC MATERIAL FOR FLUTES

[75] Inventors: Osamu Watanabe; Takashi Nara, both of Tokyo; Kojiro Akagawa; Kuniaki Nomata, both of Hamamatsu, all of Japan

[73] Assignee: Yamaha Corporation, Japan

[21] Appl. No.: 441,315

[22] Filed: Nov. 27, 1989

[30] Foreign Application Priority Data

Dec. 2, 1988 [JP] Japan ..... 63-304178
Dec. 2, 1988 [JP] Japan ..... 63-304179

[51] Int. Cl.[5] ..... C22C 5/08
[52] U.S. Cl. ..... 420/502; 84/384
[58] Field of Search ..... 84/384; 420/502, 503, 420/504

[56] References Cited

U.S. PATENT DOCUMENTS

| | | | |
|---|---|---|---|
| 2,138,638 | 11/1938 | Leach | 420/502 |
| 3,455,663 | 7/1969 | Zdanuk | 420/502 |
| 4,623,513 | 11/1986 | Mizuhara | 420/502 |

FOREIGN PATENT DOCUMENTS

| | | | |
|---|---|---|---|
| 44-23752 | 10/1969 | Japan | 420/502 |
| 45-39337 | 12/1970 | Japan | 420/502 |
| 56-146188 | 11/1981 | Japan | 84/384 |
| 56-146189 | 11/1981 | Japan | 84/384 |
| 61-34143 | 2/1986 | Japan | 420/502 |
| 61-101987 | 5/1986 | Japan | 420/502 |
| 63-75793 | 4/1988 | Japan | 84/384 |
| 244859 | 5/1969 | U.S.S.R. | 420/502 |
| 979519 | 12/1982 | U.S.S.R. | 420/502 |
| 440450 | 12/1935 | United Kingdom | 420/502 |

*Primary Examiner*—John J. Zimmerman
*Attorney, Agent, or Firm*—Lerner, David, Littenberg, Krumholz & Mentlik

[57] ABSTRACT

In the composition of a Ag alloy type material used for production of flutes, a specified amount of at least one of Ni, Fe, Co and Cr or at least one of Mn, Ti, Zi and Si is added to suppress softening and crystal grain size coarsening caused by annealing in production. Thus, flutes which generate brilliant sounds in mid to high notes can be obtained by using the above material.

12 Claims, No Drawings

METALLIC MATERIAL FOR FLUTES

BACKGROUND OF THE INVENTION

The present invention relates to metallic material for flutes, and more particularly relates to improvement in tonal quality of sounds generated by flutes made of Ag alloys.

In the field of conventional flutes, nickel silver is used for popular class flutes, Ag alloys are used for middle and high class flutes and Au alloys are used for high class flutes. In particular, coin silver (90% Ag-Cu alloy) and sterling silver (92.5% Ag-Cu alloy) have enjoyed general poularity in use for middle and high class flutes.

In the production of Ag alloy type flutes, the alloy material is subjected to repeated annealing each at a temperature in a range from 600° to 750° C. Treatment of the alloy material at such a high temperature softens the material and coarsens the crystal grain size of the alloy. With recent advances in scientific investigation of acoustic mechanisms of sounds generated by flutes, it is said that the hardness of the material and the grain size and orientation of the crystal may pose some influence on the acoustic characteristics of the sounds. From this point of view, softening of the material and coarsening the crystal grain size are believed to adversely affect the tone quality of flutes. In particular the tone colour of sounds generated by flutes.

In attempt to overcome this possible disadvantage, it is proposed that a microscopic surface waving be applied to the inner surface of a flute or that the inner surface be plated so as to control the pneumatic flow generated by blowing the flute. Despite various efforts in the field, no sufficient improvement in actual tone colour has ever been attained, particularly in the case of the popular class flutes.

SUMMARY OF THE INVENTION

It is the object of the present invention to improve tone colour of sounds generated by flutes made of Ag alloys.

In accordance with one aspect of the present invention, a metallic material for flutes contain 5 to 25% by weight of Cu, 0.05 to 1% by weight of one or more of Ni, Fe, Co and Cr, and Ag in balance.

In accordance with another aspect of the present invention, a metallic material for flutes contains 5 to 28 by weight of Cu, 0.05 to 1% by weight of one or more of Mn, Ti, Zr and Si, and Ag in balance.

DESCRIPTION OF THE PREFERRED EMBODIMENTS

According to the present invention, the metallic material contains 5 to 28% by weight of Cu. Any content below 5% by weight would make the material too soft to be used for flutes. The content of 28% by weight is the eutectic limit beyond which the workability of the material is much longer and the corrosion resistance of Ag is seriously degraded.

According to one aspect of the present invention, the material contains 0.05 to 1% by weight of one or more of Ni, Fe, Co and Cr. Any content of these elements below the lower limit would not effectively suppress the undesirable softening of the material and the coarsening of the crystal grain size during annealing. Any content above the upper limit would impair workability of the material.

According to another aspect of the present invention, the material contains 0.05 to 1% by weight of one or more of Mn, Ti Zr and Si. Any content of these elements below the lower limit would not effectively suppress the undesirable softening of the material and the coarsening of the crystal grain size during annealing. Any content above the upper limit would impair workability of the material.

EXAMPLES

EXAMPLE 1

A mixture of 1,890 g. of Ag, 100 g. of Cu, 1 g. of Fe, 6 g. of Ni, 1 g. of Co and 2 g. of Cr. was melted in a tanman furnace for casting to form a test piece, identified as Sample No. 1. After hot forging and cutting, the test piece was subjected to repeated annealing and rolling down to a thickness of 1.2 mm. Next, the test piece was heated at 750° C. for 30 minutes for measurement of crystal grain size. The test piece was further rolled down to a thickness of 1.0 mm. for measurement of hardness.

A mixture of 1,850 g. of Ag, 130 g. of Cu, 4 g. of Fe, and 16 g. of Ni was melted in a tanman furnace for casting to a form a test piece, identified as Sample No. 2. As in the case of Sample No. 1, the test piece was worked down to a thickness of 1.2 mm. for measurement of crystal grain size. The test piece was further rolled down to a thickness of 1.0 mm. for measurement of hardness.

The test piece was further worked to a pipe having a 24 mm. outer diameter, 21.6 mm. inner diameter and 1.2 mm. thickness. This pipe was further subjected to repeated annealing and extension to form a pipe of 20.5 mm. outer diameter, 19.5 mm. inner diameter and 0.5 mm. thickness. The pipe thus obtained was heated in an $N_2$ gas environment at 750° C. for 30 minutes. After skinpass treatment, the pipe was again heated in an $N_2$ gas environment at 300° C. for 2 hours for stabilization purpose. The pipe was then formed into a flute for comparison of tone colour with a flute made of the conventional material.

Further Samples Nos. 3 to 11 were prepared in the same manner as that of Sample No. 1. Samples Nos. 5 and 7 were formed into flutes like Sample No. 2.

For comparsion, Samples Nos. 12 to 14 were prepared from conventional materials in the same manner as Sample No. 1. Samples Nos. 12 and 13 were formed into flutes. The results are shown in Table 1.

TABLE 1

| | Composition (% by weight) | | | | | | Property | | |
|---|---|---|---|---|---|---|---|---|---|
| Sample | Ag | Cu | Fe | Ni | Co | Cr | I | II | III |
| 1 | 94.5 | 5.0 | 0.05 | 0.3 | 0.05 | 0.1 | 45 | 120 | |
| 2 | 92.5 | 6.5 | 0.2 | 0.8 | | | 40 | 121 | |
| 3 | 92.0 | 7.0 | | | 1.0 | | 40 | 120 | |
| 4 | 92.0 | 7.4 | 0.3 | 0.3 | | | 40 | 118 | |
| 5 | 90.0 | 9.0 | | | | 1.0 | 35 | 124 | |
| 6 | 90.0 | 9.0 | 0.8 | 0.05 | 0.15 | | 30 | 125 | |
| 7 | 90.0 | 9.2 | 0.5 | 0.1 | 0.2 | | 30 | 130 | |
| 8 | 80.0 | 19.0 | | 1.0 | | | 25 | 132 | |
| 9 | 75.0 | 24.0 | 0.2 | | | 0.8 | 25 | 145 | |
| 10 | 75.0 | 24.0 | | | 0.8 | 0.2 | 25 | 145 | |
| 11 | 71.5 | 28.0 | 0.1 | 0.2 | 0.2 | | 20 | 150 | |
| 12 | 92.5 | 7.5 | | | | | 65 | 110 | |
| 13 | 90.0 | 10.0 | | | | | 55 | 116 | |
| 14 | 75.0 | 25.0 | | | | | 50 | 128 | |

It is clear from this experimental data that, in comparison with Samples 12–14 formed from conventional materials, the samples prepared in accordance with the present invention suppress grain size enlargement and thereby maintain their hardness. By adding small produce amounts of the indicated elements to the conventional Ag-Cu alloy, grain growth is suppressed so that a grain size in the range of from about 20 um to about 45 um results. Thus, flutes generating brilliant sounds in the mid to high notes can be obtained.

EXAMPLE 2

Sample Nos. 21 to 31 in accordance with the present invention were prepared in the same manner as those in Example 1, but using the compositions shown in Table 2. For comparison purposes, Samples 32 to 34, consisting of conventional materials, were also prepared.

TABLE 2

| | Composition (% by weight) | | | | | | property | | |
|---|---|---|---|---|---|---|---|---|---|
| Sample | Ag | Cu | Mn | Ti | Zr | Si | I | II | III |
| 21 | 94.7 | 5.0 | 0.05 | 0.05 | | 0.2 | 40 | 118 | |
| 22 | 92.5 | 6.9 | | 0.5 | | 0.1 | 35 | 125 | |
| 23 | 92.5 | 6.5 | 1.0 | | | | 40 | 128 | |
| 24 | 91.0 | 8.4 | 0.5 | | 0.1 | | 35 | 125 | |
| 25 | 90.0 | 9.4 | | | 0.3 | 0.3 | 35 | 125 | |
| 26 | 90.0 | 9.5 | 0.2 | 0.2 | 0.05 | 0.05 | 30 | 130 | |
| 27 | 90.0 | 9.6 | | 0.3 | 0.1 | | 30 | 128 | |
| 28 | 81.2 | 18.0 | | 0.8 | | | 25 | 135 | |
| 29 | 80.0 | 19.6 | 0.3 | | | 0.1 | 25 | 135 | |
| 30 | 74.5 | 25.0 | | | | 0.5 | 25 | 140 | |
| 31 | 74.5 | 25.0 | | | 0.5 | | 25 | 145 | |
| 32 | 92.5 | 7.5 | | | | | 65 | 110 | |
| 33 | 90.0 | 10.0 | | | | | 55 | 116 | |
| 34 | 75.0 | 25.0 | | | | | 50 | 128 | |

*I; Crystal diameter in μm
II; Hardness in Hv
III; Tone colour excellent
good
no bad These data also will indicate the merits of the present invention.

We claim:

1. A flute formed from a metallic material comprising a composition including between about 5 weight percent and about 28 weight percent of Cu, between about 0.05 weight percent and about 1.0 weight percent of an additive selected from the group consisting of Ni, Fe, Co and Cr and combinations thereof, and a balance of Ag.

2. A flute as claimed in claim 1, wherein at least a portion of said composition is present as crystals having a grain size between about 20 um and about 45 um.

3. A flute as claimed in claim 2, wherein said grain size is between about 30 um and about 40 um.

4. A flute as claimed in claim 1, wherein said composition has a hardness between about 118 Hv and about 150 Hv.

5. A flute as claimed in claim 4 wherein said hardness is between about 120 Hv and about 130 Hv.

6. A flute formed from a metallic material comprising a composition including between about 5 weight percent and about 28 weight percent of Cu, between about 0.05 weight percent and about 1.0 weight percent of an additive selected from the group consisting of Mn, Ti, Zr and Si and combinations thereof, and a balance of Ag.

7. A flute as claimed in claim 6, wherein at least a portion of said composition is present as crystals having a grain size between about 20 um and about 45 um.

8. A flute as claimed in claim 7, wherein said grain size is between about 30 um and about 40 um.

9. A flute as claimed in claim 6, wherein said composition has a hardness between about 118 Hv and about 150 Hv.

10. A flute as claimed in claim 9, wherein said hardness is between about 120 Hv and about 130 Hv.

11. A flute having an improved tonal quality, said flute formed from a metallic material comprising a composition consisting essentially of between about 5 weight percent and about 28 weight percent of Cu, between and about 0.05 weight percent and about 1.0 weight percent of an additive selected from the group consisting of Ni, Fe, Co and Cr and combinations thereof, and a balance of Ag, said composition having a hardness between about 118 Hv and about 150 Hv, and at least a portion of said composition being present as crystals having a grain size between about 20 um and about 45 um, wherein said grain size and said hardness combine to provide said improved tonal quality of said flute.

12. A flute having an improved tonal quality, said flute formed from a metallic material comprising a composition consisting essentially of between about 5 weight percent and about 28 weight percent of Cu, between about 0.05 weight percent and about 1.0 weight percent of an additive selected from the group consisting of Mn, Ti, Zr and Si and combinations thereof, and a balance of Ag, said composition having a hardness between about 118 Hv and about 150 Hv, and at least a portion of said composition being present as crystals having a grain size between about 20 um and about 45 um, wherein said grain size and said hardness combine to provide said improved tonal quality of said flute.

* * * * *

UNITED STATES PATENT AND TRADEMARK OFFICE

CERTIFICATE OF CORRECTION

PATENT NO. : 4,971,759

DATED : November 20, 1990

INVENTOR(S) : WATANABE ET AL.

It is certified that error appears in the above-identified patent and that said Letters Patent is hereby corrected as shown below:

Column 1, line 44, "25%" should read --28%--.

Column 1, line 60, "longer" should read --lowered--.

Column 2, line 40, "purpose" should read --purposes--.

Column 2, lines 50-65, Table 1 should read:

TABLE 1

| | Composition (% by weight) | | | | | | Property | | |
|---|---|---|---|---|---|---|---|---|---|
| Sample | Ag | Cu | Fe | Ni | Co | Cr | I | II | III |
| 1 | 94.5 | 5.0 | 0.05 | 0.3 | 0.05 | 0.1 | 45 | 120 | |
| 2 | 92.5 | 6.5 | 0.2 | 0.8 | | | 40 | 121 | ⊖ |
| 3 | 92.0 | 7.0 | | | 1.0 | | 40 | 120 | |
| 4 | 92.0 | 7.4 | 0.3 | 0.3 | | | 40 | 118 | |
| 5 | 90.0 | 9.0 | | | | 1.0 | 35 | 124 | ● |
| 6 | 90.0 | 9.0 | 0.8 | 0.05 | 0.15 | | 30 | 125 | |
| 7 | 90.0 | 9.2 | 0.5 | 0.1 | 0.2 | | 30 | 130 | ◎ |
| 8 | 80.0 | 19.0 | | 1.0 | | | 25 | 132 | |
| 9 | 75.0 | 24.0 | 0.2 | | | 0.8 | 25 | 145 | |
| 10 | 75.0 | 24.0 | | | 0.8 | 0.2 | 25 | 145 | |
| 11 | 71.5 | 28.0 | 0.1 | 0.2 | 0.2 | | 20 | 150 | |
| 12 | 92.5 | 7.5 | | | | | 65 | 110 | ○ |
| 13 | 90.0 | 10.0 | | | | | 55 | 116 | ○ |
| 14 | 75.0 | 25.0 | | | | | 50 | 128 | |

UNITED STATES PATENT AND TRADEMARK OFFICE

CERTIFICATE OF CORRECTION

PATENT NO. : 4,971,759

DATED : November 20, 1990

INVENTOR(S) : WATANABE ET AL.

It is certified that error appears in the above-identified patent and that said Letters Patent is hereby corrected as shown below:

Column 3, lines 15-35, Table 2 should read:

TABLE 2

| | Composition (% by weight) | | | | | | property | | |
|---|---|---|---|---|---|---|---|---|---|
| Sample | Ag | Cu | Mn | Ti | Zr | Si | I | II | III |
| 21 | 94.7 | 5.0 | 0.05 | 0.05 | | 0.2 | 40 | 118 | |
| 22 | 92.5 | 6.9 | | 0.5 | | 0.1 | 35 | 125 | ● |
| 23 | 92.5 | 6.5 | 1.0 | | | | 40 | 128 | |
| 24 | 91.0 | 8.4 | 0.5 | | 0.1 | | 35 | 125 | |
| 25 | 90.0 | 9.4 | | | 0.3 | 0.3 | 35 | 125 | ⊖ |
| 26 | 90.0 | 9.5 | 0.2 | 0.2 | 0.05 | 0.05 | 30 | 130 | |
| 27 | 90.0 | 9.6 | | 0.3 | 0.1 | | 30 | 128 | ⊖ |
| 28 | 81.2 | 18.0 | | 0.8 | | | 25 | 135 | |
| 29 | 80.0 | 19.6 | 0.3 | | | 0.1 | 25 | 135 | |
| 30 | 74.5 | 25.0 | | | | 0.5 | 25 | 140 | |
| 31 | 74.5 | 25.0 | | | 0.5 | | 25 | 145 | |
| 32 | 92.5 | 7.5 | | | | | 65 | 110 | ○ |
| 33 | 90.0 | 10.0 | | | | | 55 | 116 | ○ |
| 34 | 75.0 | 25.0 | | | | | 50 | 128 | |

*I; Crystal diameter in μm
II; Hardness in Hv
III; Tone colour ● excellent
⊖ good
○ no bad Signed and Sealed this Seventh Day of July, 1992

*Attest:*

DOUGLAS B. COMER

*Attesting Officer*

*Acting Commissioner of Patents and Trademarks*